US008359663B2

(12) United States Patent
Blomkwist

(10) Patent No.: US 8,359,663 B2
(45) Date of Patent: Jan. 29, 2013

(54) BABYBODY

(76) Inventor: Jessica Blomkwist, Rimbo (SE)

( * ) Notice: Subject to any disclaimer, the term of this patent is extended or adjusted under 35 U.S.C. 154(b) by 186 days.

(21) Appl. No.: 12/992,815

(22) PCT Filed: May 14, 2009

(86) PCT No.: PCT/SE2009/000246
§ 371 (c)(1),
(2), (4) Date: Nov. 15, 2010

(87) PCT Pub. No.: WO2009/139684
PCT Pub. Date: Nov. 19, 2009

(65) Prior Publication Data

US 2011/0067164 A1 Mar. 24, 2011

(30) Foreign Application Priority Data

May 15, 2008 (SE) ..... 0801097

(51) Int. Cl.
*A41B 13/08* (2006.01)
*A41D 11/00* (2006.01)

(52) U.S. Cl. ..... 2/80; 2/78.2; 2/111

(58) Field of Classification Search ..... 2/111, 80, 2/83, 78.1, 78.2, 78.3, 71, 72, 75, 402, 114, 2/400, 401, 408, 109, 73; D2/714, 733
See application file for complete search history.

(56) References Cited

U.S. PATENT DOCUMENTS

| | | | | | |
|---|---|---|---|---|---|
| 1,007,995 | A | * | 11/1911 | Webb | 2/78.1 |
| 1,147,962 | A | * | 7/1915 | Matty | 2/78.1 |
| 1,156,301 | A | * | 10/1915 | Luckett | 2/78.2 |
| 1,243,583 | A | * | 10/1917 | Bohannon | 2/80 |
| 1,339,116 | A | * | 5/1920 | Luckett | 2/78.2 |
| 1,341,317 | A | * | 5/1920 | Hanna | 2/83 |
| 1,404,629 | A | * | 1/1922 | Miller | 2/78.2 |
| 1,610,792 | A | * | 12/1926 | Kassap | 2/78.3 |
| 1,787,098 | A | * | 12/1930 | Wolff | 2/78.2 |
| 1,853,396 | A | * | 4/1932 | Atherton | 2/78.2 |
| 1,911,676 | A | * | 5/1933 | Craig | 2/78.2 |
| 2,106,553 | A | * | 1/1938 | Le Coney | 2/78.2 |
| 2,116,360 | A | * | 5/1938 | Lindh | 2/78.2 |
| 2,300,667 | A | * | 11/1942 | Guignion | 2/78.2 |

FOREIGN PATENT DOCUMENTS

| | | | |
|---|---|---|---|
| AU | 2007100570 | A4 | 8/2007 |
| GB | 1214913 | A | 12/1970 |
| JP | 2003027310 | A | 1/2003 |
| JP | 2008231631 | A | 10/2008 |
| SE | 529405 | C2 | 7/2007 |

OTHER PUBLICATIONS

International Search Report, dated Aug. 19, 2009, from corresponding PCT application.

* cited by examiner

*Primary Examiner* — Amy Vanatta
(74) *Attorney, Agent, or Firm* — Young & Thompson

(57) ABSTRACT

A babybody includes a front piece (1) and a back piece, two shoulder sections (4) and a crotch (2). The distinguishing features of the babybody are that the back piece includes an outerlying element (3) and an innerlying element (5), that the innerlying element (5) has a free upper edge (10) and that an intermediate portion of the upper free edge (10) is situated at a level which is nearer to the crotch (2) than the ends of the upper free edge (10).

12 Claims, 4 Drawing Sheets

BABYBODY

TECHNICAL FIELD OF THE INVENTION

The present invention relates to a babybody which comprises a front piece and a back piece, two shoulder sections and a crotch.

STATE OF THE ART

A garment for children which has overlapping pieces of fabric in the rear section of the garment is known from GB 1,214,913. These overlapping pieces of fabric have horizontal free edges and there is also a difference relative to the babybody according to the present invention in that the piece which extends downwards from the waist lies outside the piece which extends downwards from the shoulders.

OBJECTS AND FEATURES OF THE INVENTION

A primary object of the present invention is to propose a babybody which makes it easier to inspect a nappy which a wearer of the babybody may have on him/her. This also applies even if the wearer of the babybody has a pair of pants or trousers on outside the babybody.

At least the first object of the present invention is achieved by a device which has the features indicated in the attached independent claim 1. Preferred embodiments of the invention are defined in the dependent claims.

BRIEF DESCRIPTION OF THE DRAWINGS

Preferred embodiments of the invention are described below with reference to the attached drawings, in which.

DETAILED DESCRIPTION OF PREFERRED EMBODIMENTS OF THE INVENTION

Figure 1:
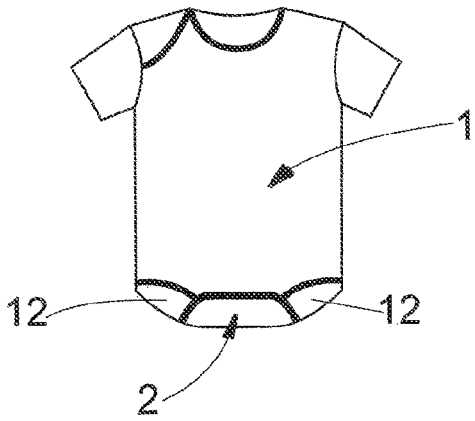
FIG. 1 depicts a baby garment according to the present invention as seen from in front.

The babybody according to the present invention as seen from the front in FIG. 1 comprises a front piece 1 with a conventional cut, i.e. the front piece extends from the region of the shoulders down to the region of the crotch 2. The apertures 12 for the legs are also visible in FIG. 1.

Figure 2:
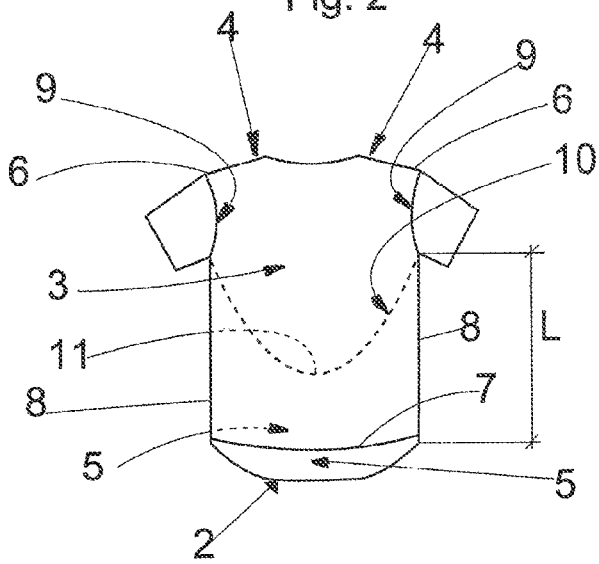
FIG. 2 depicts a first embodiment of a babybody according to the present invention as seen from behind.

FIG. 2 depicts the back piece of the babybody according to FIG. 1. It shows the back piece comprising two partly overlapping elements/pieces of fabric 3 and 5. An outerlying piece of fabric 3 has an extent from the shoulder sections 4 down to the region of the upper portion of the leg apertures 12, i.e. the lower free end 7 of the outerlying piece of fabric 3 is situated level with the portion of the leg apertures 12. The outerlying piece of fabric 3 is sewn to the front piece 1 in the region of the babybody's shoulder sections 4.

An innerlying piece of fabric 5 has an extent from the region of the armholes 9 down to the babybody's crotch 2 where the innerlying piece of fabric 5 is connected to the conventional front piece 1, this connection being usually by buttoning. The babybody thus has an openable crotch for dressing/undressing purposes. As illustrated in FIG. 2, the innerlying piece of fabric 5 connects to a lower portion of the armholes 9.

The upper free edge 10 (represented by a broken line in FIG. 2) of the innerlying piece 5 has a special cut which is characterising for the babybody according to the present invention. Thus according to the embodiment depicted, the upper free edge 10 of the innerlying piece 5 is arcuate/circular and an intermediate portion 11 of the upper free edge 10 of the innerlying piece 5 is situated at a level which is nearer to the crotch 2 than the portions of the innerlying piece 5 which connect to the armholes 9.

Both the outerlying piece 3 and the innerlying piece 5 are sewn to the front piece 1 along the side seams 8/sides of the babybody according to the present invention. In FIG. 2, the length of one side seam/side is designated L. The other side seam 8/side is also of similar length.

Figure 3:
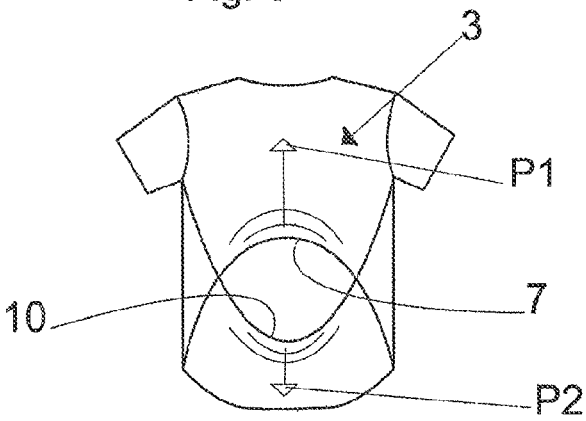
FIG. 3 depicts the built-in function of the first embodiment.

In FIG. 3, the arrows P1 and P2 indicate how inspection of a nappy of a child wearing the babybody according to the present invention is carried out. Thus a person intending to inspect the nappy can both move the lower free edge 7 of the outerlying piece 3 upwards, see arrow P1, and move the upper free edge 10 of the innerlying piece 5 downwards, see arrow P2. If these two steps are carried out simultaneously, the upper edge of the nappy is revealed, making it easy to look down into the nappy in order to inspect its current state.

Figure 4:
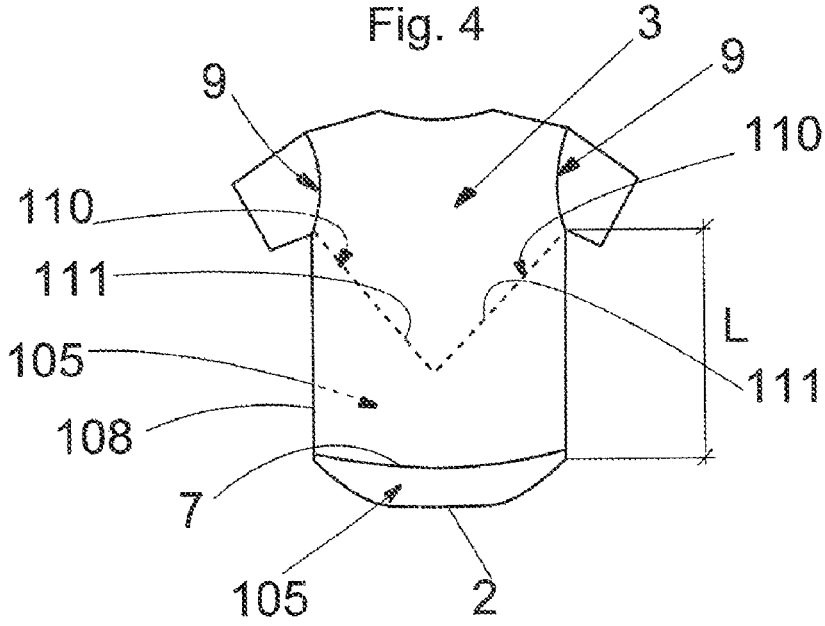
FIG. 4 depicts a second embodiment of a babybody according to the present invention.

FIG. 4 depicts the back piece of an alternative embodiment of a babybody according to the present invention, in which the configuration of the outerlying piece 3 is similar to the embodiment according to FIGS. 2 and 3. This outerlying piece 3 is therefore given the same reference notation, i.e. "3".

FIG. 4 shows the upper free edge 110 of the innerlying piece 105 with a somewhat different cut than that of the innerlying piece 5 depicted in FIG. 2. The upper free edge 110 of the innerlying piece 105 here has a V-shaped configuration. The upper corner portions of the innerlying piece 105 connect to the front piece in the region of the lower portion of the armholes 9. The upper free edge 110 of the innerlying piece 105 extends diagonally downwards from the respective corner portions to a point which defines the tip of the "V". The upper free edge 110 of the innerlying piece 105 thus comprises two substantially straight edge portions which meet in a tip. An intermediate portion of the upper free edge 110 of the innerlying piece 105 is situated at a level which is nearer to the crotch 2 than the portions of the innerlying piece 105 which connect to the armholes 9.

Figure 5:
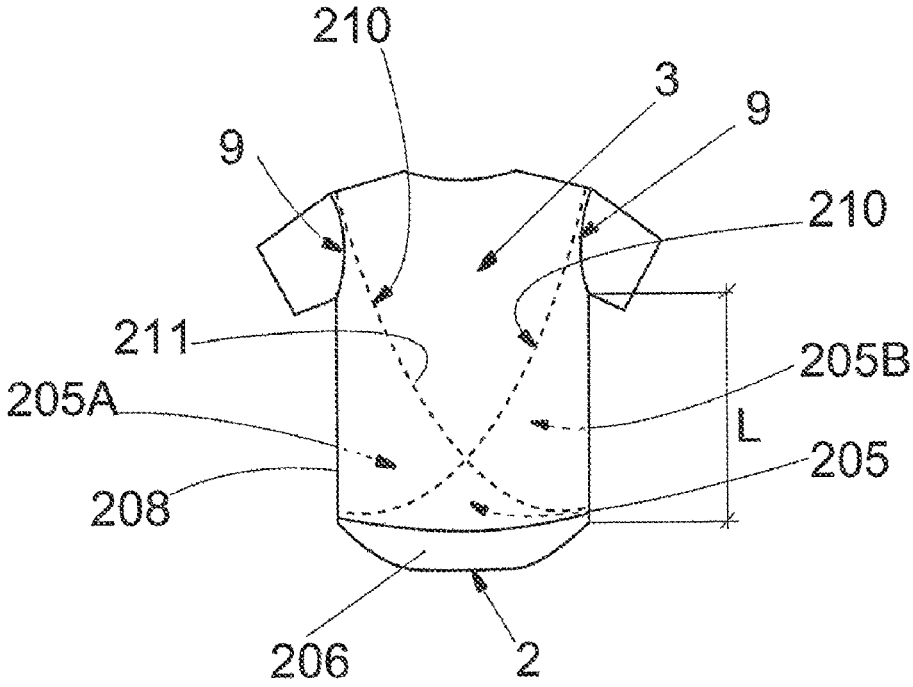
FIG. 5 depicts a third embodiment of a babybody according to the present invention.

FIG. 5 depicts a further alternative embodiment of a babybody according to the present invention, in which the configuration of the outerlying piece 3 corresponds to that in the embodiment according to FIGS. 2 and 3. This outerlying piece 3 is therefore given the same reference notation, i.e. "3".

Figure 5A:
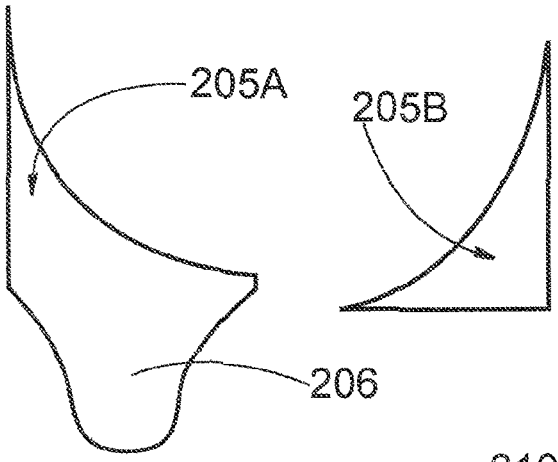
FIG. 5A depicts an exploded view of the constituent parts of the back piece in the third embodiment.
Figure 5B:
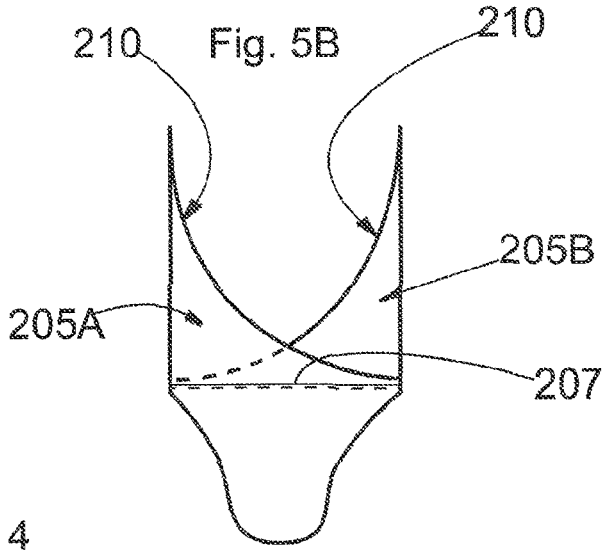
FIG. 5B depicts the parts sewn together to form the back piece in the third embodiment.

In the embodiment according to FIG. 5, the innerlying piece 205 comprises two subpieces of fabric 205A and 205B parted in FIG. 5A, which shows the subpiece 205A comprising a portion 206 which extends down to the crotch. The two subpieces 205A and 205B are sewn together to form the piece 205 depicted in FIG. 5B. The subpieces 205A and 205B are with advantage sewn together by a seam 207 depicted as a continuous line in FIG. 5B. When the two subpieces 205A and 205B are sewn together as depicted in FIG. 5B, the result is an upper free edge 210 of the innerlying piece 205 which has an intermediate portion situated at a level which is nearer to the crotch 2 than the portions of the innerlying piece 205 which connect to the armholes 9.

Figure 6:
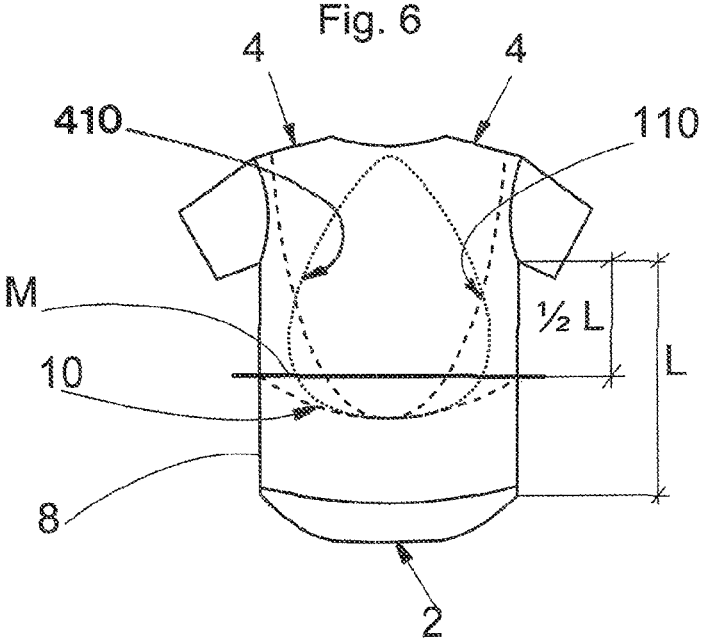
FIG. 6 depicts extreme positions for the upper free edges of an innerlying piece of fabric of the babybody according to the present invention.

FIG. 6 depicts schematically how the configuration of the upper free edge 10; 110; 210; 410 of the innerlying piece 5; 105; 205 may vary, i.e. it shows the two extreme positions for the points for fastening the ends of the upper free edge 10; 110; 210 of the innerlying piece 105. As illustrated in FIG. 6, in one extreme position, represented by the upper free edge 410, the fastening points for the ends of this innerlying piece are situated in the region of the neckband, and in principle the fastening points meet in the region of the neckband. In the second extreme position for the fastening points, the ends of the upper free edge 10; 110; 210 of the innerlying piece 5; 105; 205 are connected to the side seams 8/sides in the region of half the height of the latter. This is illustrated by there being a distance of ½ L from the upper end of the side seam 8/side to the continuous line M, the intersection of which with the side seams 8/sides defines the fastening points for the upper free edge 10; 110; 210 of the innerlying piece 5; 105; 205.

Figure 7:
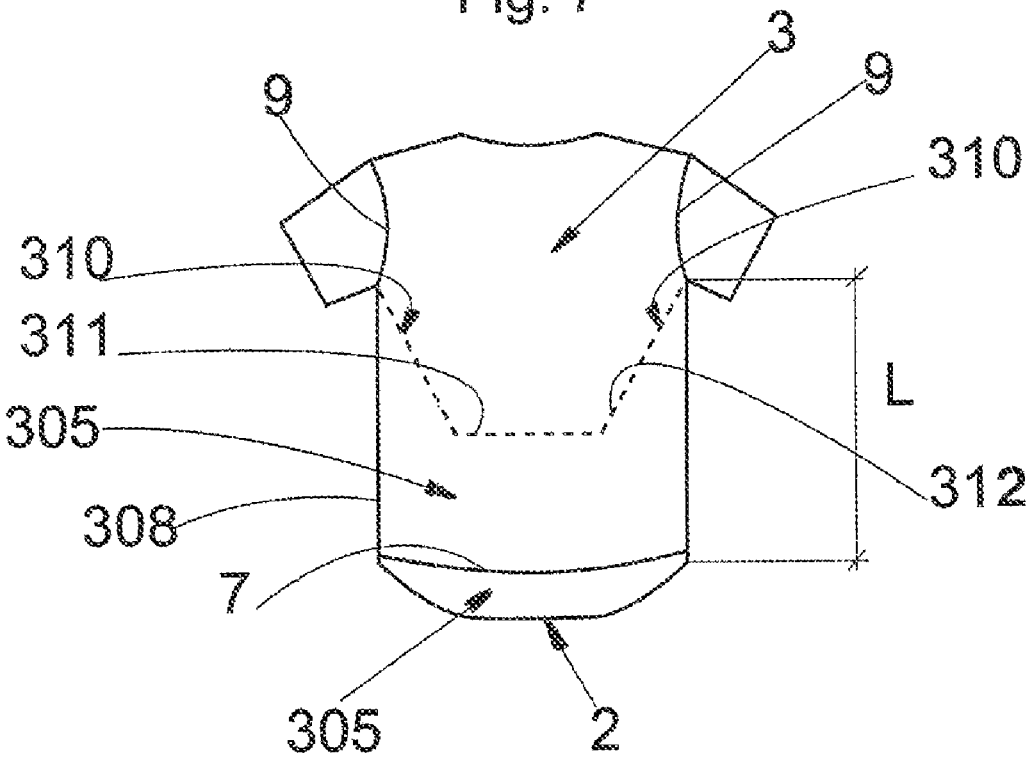
FIG. 7 depicts a further embodiment of the babybody according to the present invention.

The babybody according to the present invention depicted in FIG. 7 comprises a front piece (not visible) with a conventional cut, i.e. the front piece extends from the region of the shoulders down to the region of the crotch 2.

The back piece of the babybody depicted in FIG. 7 comprises two partly overlapping elements/pieces of fabric 3 and 305. An outerlying piece of fabric 3 has an extent from the shoulder sections down to the region of the upper portion of the leg apertures, i.e. the lower free edge 7 of the outerlying piece of fabric 3 is situated level with the portion of the leg apertures. The outerlying piece of fabric 3 is sewn to the front piece in the region of the babybody's shoulder sections.

An innerlying piece of fabric 305 has an extent from the region of the armholes 9 down to the babybody's crotch 2 where the innerlying piece of fabric 305 is connected to the conventional front piece, this connection being usually by buttoning. The babybody thus has an openable crotch for dressing/undressing purposes. As illustrated in FIG. 7, the innerlying piece of fabric 305 connects to a lower portion of the armholes 9.

The upper free edge 310 (in the form of a broken line in FIG. 7) of the innerlying piece 305 has a special cut which is characterising for the babybody according to the present invention. Thus according to the embodiment depicted, the upper free edge 310 of the innerlying piece 305 is composed of three substantially straight portions, viz. an intermediate horizontal portion 311 and two diagonal portions 312 which extend out from the respective ends of the intermediate portion 311 to the babybody's side seams/sides 308. The intermediate portion 311 of the upper free edge 310 of the innerlying piece 305 is situated at a level which is nearer to the crotch 2 than the portions of the innerlying piece 305 which connect to the armholes 9.

Both the outerlying piece 3 and the innerlying piece 5 305 are sewn to the front piece along the side seams/sides 8 of the babybody according to the present invention. In FIG. 7, the length of one side seam/side is designated L. The other side seam/side 8 is also of similar length.

Intermediate portion in this context, i.e. for all the embodiments, means a portion which constitutes 50% of the total length of the upper free edge 10; 110; 210; 310; 410 and which extends in both directions from the midpoint of the upper free edge 10; 110; 210; 410; 410.

Generally speaking, with the present invention there is normally no need for elastic at the free lower edge 7 of the outerlying piece 3 or at the free upper edge 10; 110; 210; 310; 410 of the innerlying piece 5; 105; 205; 305.

Conceivable Modifications of the Invention

The babybody described above has no legs but it is possible within the scope of the present invention to conceive of the babybody being provided with legs.

In the embodiment described above, the lower free edge 7 of the outerlying piece 3 extends to level with the upper portion of the leg apertures 12. Within the scope of the present invention it is conceivable that the lower free edge 7 of the outerlying piece 3 may end higher up, but the lower free edge 7 of the outerlying piece 3 would need to be situated further down than the lowest point on the upper free edge of the innerlying piece 5.

In the embodiment described above, the outerlying piece 3 is sewn to the front piece 1. Within the scope of the present invention it is conceivable for the outerlying piece 3 and the front piece 1 to be integral, in which case an aperture for the neck would be accommodated therein.

In the embodiment described above, the babybody is provided with an openable crotch for dressing/undressing purposes. A non-limitative example which may be mentioned is an openable neckbanding whereby an aperture is situated on the front side of the babybody or elsewhere on the babybody. It is also possible to use a variety of methods for closing the aperture (buttons, zipper, velcro etc.).

In the embodiment described above, the innerlying piece 205 is sewn together from the subpieces 205A and 205B. Within the scope of the present invention, however, it is conceivable to only use the subpiece 205A without sewing it to the subpiece 205B, i.e. to omit the subpiece 205B. In that case, only one end of the upper free edge of the innerlying piece 205A would be situated further away from the crotch than the intermediate portion of the upper free edge.

The invention claimed is:

1. A babybody comprising a front piece (1) and a back piece that are mutually connected by side seams (8), two shoulder sections (4) a crotch (2), and apertures (12) for the legs being provided adjacent the crotch (2), wherein the back piece comprises an outerlying element (3) and an innerlying element (5; 105; 205), wherein the outerlying element (3) extends from both of the two shoulder sections (4) down to the region of an upper portion of the apertures (12) for the legs, wherein the outerlying element (3) has a free lower edge (7) extending between the side seams (8), wherein the innerlying element (5; 105; 205) has a free upper edge (10; 110; 210; 310; 410), the free upper edge (10; 110; 210; 310; 410) extending from a first end to a second end, and wherein an intermediate portion of the free upper edge (10; 110; 210; 310; 410) is situated at a level which is nearer to the crotch (2) than at least one of the first end and the second end of the free upper edge (10; 110; 210; 310; 410).

2. The babybody according to claim 1, wherein the intermediate portion of the upper free edge (10; 110; 210; 310; 410) is situated at a level which is nearer to the crotch (2) than the first end and the second end of the upper free edge (10; 110; 210; 310; 410).

3. The babybody according to claim 1, wherein the upper free edge (10) is arcuate.

4. The babybody according to claim 1, wherein the upper free edge (110; 210) is V-shaped.

5. The babybody according to claim 1, wherein the upper free edge (310) is composed of straight portions (311, 312).

6. The babybody according to claim 1, wherein the first end and the second end of the upper free edge (10; 110; 210; 310; 410) of the innerlying element (5; 105; 205; 305) are situated between the shoulder sections (4) and a region of half the height (M) of the side seams (8).

7. The babybody according to claim 1, wherein the outerlying element (3) and the front piece (1) are integral.

8. The babybody according to claim 4, wherein the innerlying element (205) comprises two subpieces (205A, 205B) which are sewn together with one another.

9. The babybody according to claim 2, wherein the upper free edge (10) is arcuate.

10. The babybody according to claim 2, wherein the upper free edge (110; 210) is V-shaped.

11. The babybody according to claim 2, wherein the upper free edge (310) is composed of straight portions (311, 312).

12. A babybody comprising:

a front piece (1) constructed and arranged to be worn on a front side of a user;

a back piece connected to the front piece (1) via a left side seam (8), a right side seam (8), a left shoulder section (4), a right shoulder section (4), and a detachable crotch (2), the front piece, the back piece, and the detachable crotch defining a pair of leg apertures (12), the back piece constructed and arranged to be worn on a back side of the user and including:

an outerlying element extending from the left shoulder section (4) and the right shoulder section (4) toward an upper portion of the leg apertures (12), the outerlying element defining a free lower edge (7) extending from the right side seam (8) to the left side seam (8), and an innerlying element (5; 105; 205) disposed between the outerlying element and the user, the innerlying element (5; 105; 205) defining a free upper edge (10; 110; 210; 310; 410) extending from a first end located at one of the left side seam (8) and the left shoulder section (4) toward a second end located at one of the right side seam (8) and the right shoulder section (4);

wherein an intermediate portion of the free upper edge (10; 110; 210; 310; 410) is situated at a level which is nearer to the detachable crotch (2) than at least one of the first end and the second end of the free upper edge (10; 110; 210; 310; 410);

wherein, only when both pulling up on the free lower edge and pulling down on the free upper edge, the back piece defines an inspection opening constructed and arranged to allow internal inspection of a diaper at a waistline of the diaper.

* * * * *